United States Patent [19]

Crook et al.

[11] 4,388,623

[45] Jun. 14, 1983

[54] ANTENNAS

[75] Inventors: Richard W. Crook, Coalville; Ian Coghill, Cannock, both of England

[73] Assignee: The Marconi Company Limited, Chelmsford, England

[21] Appl. No.: 165,952

[22] Filed: Jun. 26, 1980

[30] Foreign Application Priority Data

Jun. 28, 1979 [GB] United Kingdom ..... 7922563
Nov. 19, 1979 [GB] United Kingdom ..... 7939908

[51] Int. Cl.[3] ..... H01Q 1/34; H01Q 19/12

[52] U.S. Cl. ..... 343/709; 343/766; 343/840

[58] Field of Search ..... 343/761, 775, 779, 781 R, 343/781 P, 835, 837, 839, 897, 718, 908, 907, 711, 900, 912, 709; 264/105; 428/408, 902

[56] References Cited

U.S. PATENT DOCUMENTS

| | | | |
|---|---|---|---|
| 2,495,219 | 1/1950 | Beck | 343/835 |
| 2,598,475 | 5/1952 | White, Jr. | 343/781 |
| 2,605,413 | 7/1952 | Alvarez | 343/835 |
| 2,769,170 | 10/1956 | Clogston | 343/907 |
| 3,716,869 | 2/1973 | Gould, Jr. et al. | 343/912 |
| 4,020,202 | 4/1977 | Kreft | 428/902 |
| 4,134,120 | 1/1979 | DeLoach et al. | 343/900 |

*Primary Examiner*—Theodore M. Blum
*Attorney, Agent, or Firm*—Spencer & Kaye

[57] ABSTRACT

The invention provides an antenna having a large area reflector formed of a plurality of conductive slats of carbon fibre re-inforced plastics material having air gaps therebetween. The slats are mounted on a supporting and shaping framework which is of like material. The supporting and shaping framework is carried on a support structure of aluminium and between the aluminium and the support structure and the carbon fibre reinforced plastics material of the supporting and shaping framework is provided the intermediary material (e.g. titanium or stainless steel provided to reduce the effects of electrolytic corrosion.

15 Claims, 5 Drawing Figures

ANTENNAS

This invention relates to antennas and in particular to antennas of the kind incorporating relatively large reflectors. Antennas of this kind are commonly used for such purposes as marine radar systems and are commonly scanable.

One difficulty which arises with such antenna, due to their size and the fact that they are inherently required to be mounted in an exposed position (e.g. at a mast head in the case of a marine radar antenna) is that of wind loading. The drag of the antenna makes them susceptible to mechanical damage due to the wind induced stresses.

It is known to reduce the effects of wind loading and incidently to reduce the weight of the antenna, by forming the reflector not of a solid sheet of reflective material but in skeleton form utilising a plurality of conductive slats.

Figure 1:
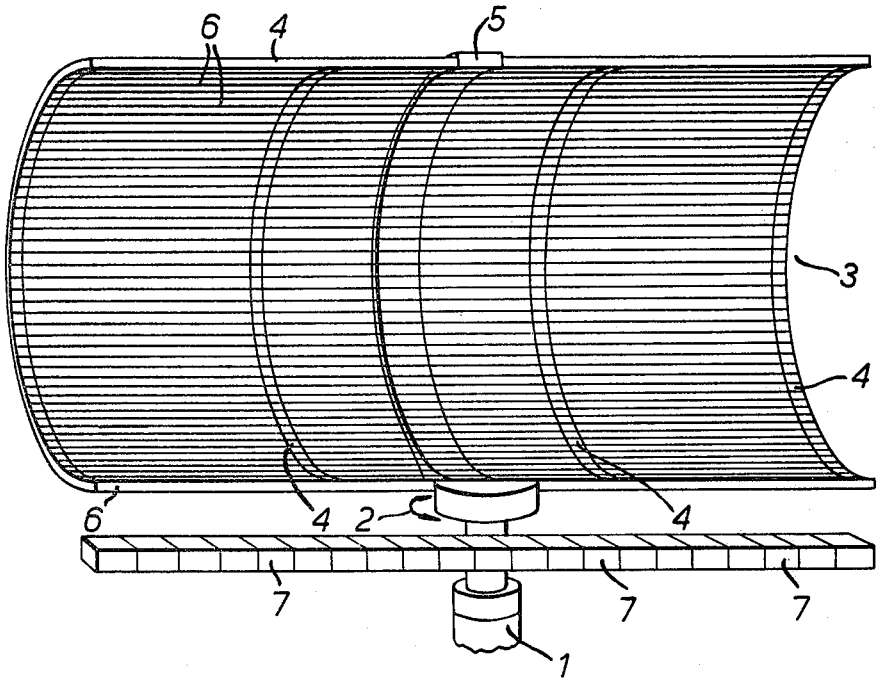

A typical antenna of the kind just described is illustrated in highly schematic manner in FIG. 1 of the accompanying drawings.

Figure 2:
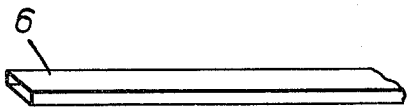

Referring to FIG. 1 the antenna is a marine radar antenna represented as carried at the top of a mast 1 for rotation in azimuth as represented by the double-headed arrow 2. A principal part of the antenna is the reflector 3 which in this case is a single curvature parabolic reflector. The reflector 3 consists of a framework 4 attached to a support structure 5. Carried by the framework 4 is a series of horizontally extending slats 6 each of which is, as illustrated in FIG. 2, formed of a rectangularly sectioned aluminium tube.

Thus the effects of wind loading on the antenna are very much reduced because of the air gaps between the individual slats making up the reflective surface. The electrical design of such a reflector is by now well known, its reflecting performance being dependent upon the air gap between the slats 6, the depth of the slats 6, the electrical properties of the slat material and the relative direction of the slats 6. The reflector formed by the slats 6 is fed by a linearly extending array of horns 7 mounted to rotate with the reflector. Tube is normally used for the slats 6 rather than solid bar for the purposes of weight saving. However, a serious disadvantage with the use of aluminium tube for this purpose is that its resistance to collapse is relatively low and the whole reflector is relatively fragile even with a substantial backing structure.

The present invention seeks to provide an improved antenna of the kind referred to in which the above difficulty is mitigated.

According to this invention an antenna having a relatively large area reflector formed of a plurality of conductive slats having air gaps therebetween is provided wherein said slats are formed of carbon fibre re-inforced plastics material.

Preferably said reflector is a single curvature parabolic reflector and said slats are linear and extend in an axial direction.

The invention is particularly applicable to marine radar antennas provided to be scanable and provided for mast head mounting.

It has been found that not only are the reflective properties of the reflector of an antenna in accordance with the present invention satisfactory but also it has been found that compared to an equivalent reflector of known form utilising solid or tubular aluminium slats the thickness of the slats of carbon fibre re-inforced plastics material can be considerably reduced and a further quite signficant reduction in wind drag achieved. As compared with slats formed of tubular aluminium or indeed solid aluminium, the strength of the slat provided by the present invention is very considerably enhanced.

According to a feature of this invention, a supporting and shaping framework to which said slats are mounted is also comprised of carbon fibre re-inforced plastics material.

Preferably said framework consists of a plurality of contoured back plates extending transversely to said slats, with said contoured back plates having surfaces to which said slats are attached and which surfaces are shaped in accordance with the desired shape of said reflector.

Preferably said contoured back plates are mechanically linked independently of said slats by at least two members extending in the same direction as said slats with said last mentioned members being fixed to each of said contoured back plates.

Preferably said last mentioned at least two members are tubular members passing through at least intermediary ones of said contoured back plates.

Preferably said reflector with its supporting and shaping frame-work is mounted onto an aluminium support structure which forms part of a pedestal for said antenna via the intermediary of a material (titanium or stainless steel for example) which reduces the effects of electrolytic corrosion compared to the effects which would otherwise be experienced if the carbon fibre re-inforced plastics material of said supporting and shaping framework were connected directly to said aluminium support structure.

Preferably a number of said contoured back plates are extended beyond said slats towards said support structure and said support structure has a like number of posts aligned with and extending towards said extended contoured back plates said posts and said extended contoured back plates being fixed together by means of fish plates of said intermediary material.

In this last mentioned case, the adjacent ends of the contoured back plates and said posts may be merely spaced apart but preferably between each end of a contoured back plate and the corresponding end of a post, a pad acting as a barrier of said intermediary material is provided.

Normally said reflector is arranged to be fed by an array of radio horns extending parallel to and adjacent one longitudinal edge of said reflector in which case preferably a series of further slats of progressively decreasing lengths extend from said longitudinal edge so as to form a skirt tending to screen the space which would otherwise exist between said array of horns and said longitudinal edge of said reflector whereby to reduce spurious scattered radiations.

Figure 3:
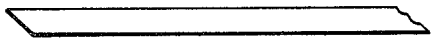
Figure 4A:
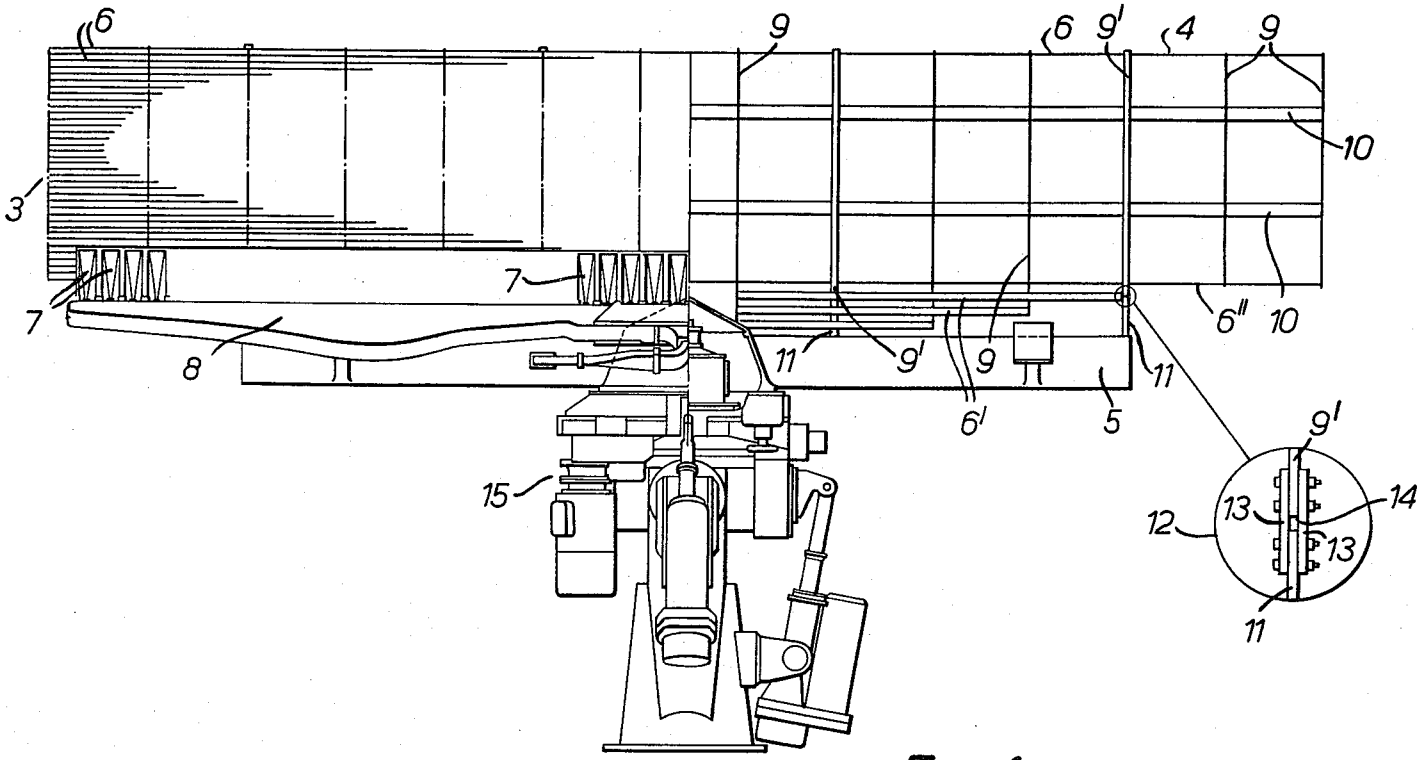
Figure 4B:
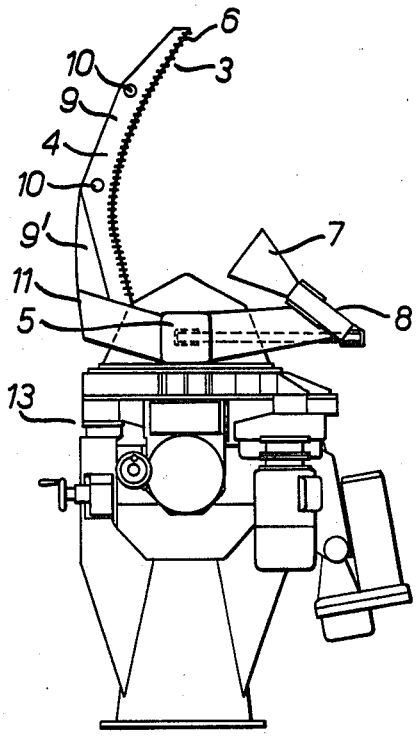

The invention is further described with reference to FIGS. 3, 4*a* and 4*b* of the accompanying drawings of which FIG. 3 illustrates one slat of carbon re-inforced plastics material which is utilised in accordance with the present invention to replace the tubular aluminium slats 6 in the antenna illustrated in FIG. 1, and FIGS. 4*a* and 4*b* are respectively front and side elevations of one practical antenna in accordance with the present invention.

Referring to FIG. 3, the design of the reflector electrically is still conventional and its reflecting performance created still depends upon the air gap between the slats, the depth of the slats, the electrical properties of the slat material, and the reflective direction of the slats. However, it has been found that for the same electrical performance as an aluminium slatted reflector the slats of carbon fibre re-inforced plastics material provided by the present invention may be considerably thinner than the corresponding aluminium slats (tubular or solid) in which case, whilst considerably enhanced strength with satisfactorily low weight is achieved, in addition wind drag is also reduced considerably by virtue of the reduced thickness of the slats.

Environmental tests have indicated that the slats of carbon fibre re-inforced plastics material utilised in the present invention have a satisfactory resistance to climatic conditions and funnel gases typically exhausted by a marine vessel.

Whilst a number of carbon fibre re-inforced plastics material are available, in the example of the invention described with reference to FIG. 3 the material is that produced by Courtaulds under the trade name "Grafil Pultrusions".

Referring to FIGS. 4*a* and 4*b*, the reflector 3 is again formed of slats such as those referenced 6 of carbon fibre re-inforced plastics material. The reflector 3 is fed by a linearly extending array of horns such as those referenced 7 extending across the reflector 3. The horns 7 are fed from a common feed waveguide 8 arranged, as known per se, such that the feed provided by the horns 7 is a "squintless" feed.

To the right, as viewed, in the front elevation shown in FIG. 4*a* the slats 6, the horns 7 and the common feed waveguide 8 are shown cut away so as to enable the reflector supporting and shaping framework 4 to be seen.

The framework 4 consists of a number (in this case 14) of contoured back plates 9, 9′ to which the slats 6 are attached. The contoured shape of the back plates 9, 9′ are such as to provide the required single curvature parabolic shape required of the reflector 3. Extending longitudinally through the back plates 9, 9′ are two tubular members 10 fixedly united with the plates 9, 9′ so as to form a rigid structure.

The four contoured back plates referenced 9′ are thicker than those referenced 9 and extend downwardly as viewed to provide for the mounting of the reflector 3 upon the support structure 5.

The support structure 5 is of aluminium whilst the entire reflector 3 comprising the slats 7, the contoured back plates 9 (including 9′) and the tubular members 10 are of carbon fibre re-inforced plastics material. As shown the aluminium support structure 5 has four up-standing posts 11 which are aligned with, and of thickness similar to that of, the downwardly extending contoured back plates 9′. The method of supporting the contoured back plates 9′ from the up-standing posts 11 is shown for one of these by inset 12. As represented, each back plate 9′ is clamped to its respective support post 11 by two fish plates 13 of titanium. The ends of the back plates 9′ and the posts 11 do not abut but are separated in each case by a pad of titanium referenced 14 in the inset.

The object of mounting the reflector of carbon fibre re-inforced plastics material in this fashion is to avoid contact between the aluminium of the support structure 5 and the carbon fibre re-inforced plastics material of the reflector 3 since such contact could give rise to electrolytic corrosion.

Furthermore by mounting the reflector 3 by means of four up-standing posts 11, a degree of lateral flexibility is provided permitting some resilient movement of the reflector 3 in the longitudinal direction with respect to the support 5.

The pedestal 15 which carries the support 5, whilst shown in some detail, will not be described in any detail since its nature is not material to the present invention. In this particular case it is such as to provide azimuth rotation of the support 5 carrying the reflector 3, with stabilisation.

As may be seen looking to the right in FIG. 4*a*, a series of further slats 6′ are provided to extend from the longitudinal lower edge formed by slat 6″ of the reflector to form a skirt tending to screen the space which would otherwise exist beneath the horns 7, and between the horns 7 and the reflector 3. The object of this is to reduce spurious scattered radiations. As will be seen, the lengths of the slats 6′ progressively decrease so that the bottom edge of the skirt formed tapers from both ends of the reflector towards the centre.

We claim:

1. An antenna having a relatively large area reflector formed of a plurality of conductive slats having air gaps therebetween wherein said slats are formed of carbon fibre re-inforced plastics material, with said material providing the reflective surfaces of said slats for energy incident thereupon.

2. An antenna as claimed in claim 1 wherein said reflector is a single curvature parabolic reflector, and said slats are linear and extend in an axial direction.

3. A marine radar antenna as claimed in claim 1 provided to be scanable and mast head mounted.

4. An antenna as claimed in claim 1 wherein a supporting and shaping framework to which said slats are mounted is also comprised of carbon fibre re-inforced plastics material.

5. An antenna as claimed in claim 4 wherein said framework consists of a plurality of contoured back plates extending transversely to said slats, said contoured back plates having surfaces to which said slats are attached which surfaces are shaped in accordance with the desired shape of said reflector.

6. An antenna as claimed in claim 5 wherein said contoured back plates are mechanically linked independently of said slats by at least two members extending in the same direction as said slats, said last mentioned members being fixed to each of said contoured back plates.

7. An antenna as claimed in claim 6 wherein said last mentioned at least two members are tubular members passing through at least intermediary one of said contoured back plates.

8. An antenna as claimed in claim 4 wherein said reflector with its supporting and shaping framework is mounted onto an aluminium support structure which forms part of a pedestal for said antenna via the intermediary of a material which reduces the effects of electrolytic corrosion compared to the effects which would otherwise be experienced if the carbon fibre re-inforced plastics material of said supporting and shaping framework were connected directly to said aluminium support structure.

9. An antenna as claimed in claim 8 wherein said intermediary material is titanium.

10. An antenna as claimed in claim 8 wherein said intermediary material is stainless steel.

11. An antenna as claimed in claim 8 wherein a number of said contoured back plates are extended beyond said slats towards said support structure and said support structure has a like number of posts aligned with and extending towards said extended contoured back plates, said posts and said extended contoured back plates being fixed together by means of fish plates of said intermediary material.

12. An antenna as claimed in claim 11 wherein the adjacent ends of the contoured back plates and said posts are merely spaced apart.

13. An antenna as claimed in claim 11 wherein between each end of a contoured back plate and the corresponding end of a post, a pad acting as a barrier of said intermediary material is provided.

14. An antenna as claimed in claim 1 wherein said reflector is arranged to be fed by an array of radio horns extending parallel to and adjacent one longitudinal edge of said reflector.

15. An antenna as claimed in claim 14 wherein a series of further slats of progressively decreasing lengths extend from said longitudinal edge so as to form a skirt tending to screen the space which would otherwise exist between said array of horns and said longitudinal edge of said reflector whereby to reduce spurious scattered radiations.

* * * * *